United States Patent [19]

Mizuno

[11] 4,369,817

[45] Jan. 25, 1983

[54] WEFT PICKING DEVICE OF AIR JET TYPE WEAVING LOOM

[75] Inventor: Yukio Mizuno, Kodaira, Japan

[73] Assignee: Nissan Motor Company Limited, Japan

[21] Appl. No.: 973,586

[22] Filed: Dec. 27, 1978

[30] Foreign Application Priority Data

Jan. 6, 1978 [JP] Japan ..... 53-263

[51] Int. Cl.[3] ..... D03D 47/30

[52] U.S. Cl. ..... 139/435

[58] Field of Search ..... 139/435; 226/95, 97

[56] References Cited

U.S. PATENT DOCUMENTS

| | | | |
|---|---|---|---|
| 3,181,571 | 5/1965 | Scheffel | 139/435 |
| 3,519,030 | 7/1970 | Vermeulen | 139/435 |
| 4,081,000 | 3/1978 | Wollenmann | 139/435 |
| 4,133,353 | 1/1979 | Larmit | 139/435 |
| 4,143,681 | 3/1979 | Kada et al. | 139/435 |

FOREIGN PATENT DOCUMENTS

| | | | |
|---|---|---|---|
| 50-64573 | 5/1975 | Japan . | |
| 206419 | of 1972 | U.S.S.R. | 139/435 |

*Primary Examiner*—Henry Jaudon

*Attorney, Agent, or Firm*—Robert E. Burns; Emmanuel J. Lobato; Bruce L. Adams

[57] ABSTRACT

A weft picking device for an air jet type weaving loom, is provided with a weft inserting nozzle which is formed with a high pressure air ejecting passage, and a low pressure air ejecting passage, so that a weft yarn introduced into the nozzle is inserted through the shed of warp yarns under cooperation of the high and low pressure air in order to save required energy for operating the weaving loom.

9 Claims, 3 Drawing Figures

WEFT PICKING DEVICE OF AIR JET TYPE WEAVING LOOM

BACKGROUND OF THE INVENTION

This invention relates to a weft picking device of an air jet type weaving loom wherein a weft yarn is picked into the shed of warp yarns by the action of air jet, and more particularly to an improvement in a weft inserting nozzle of the weft picking device of the air jet type loom.

In conventional air jet type looms, picking of weft yarn has been carried out by ejecting air jet through an annular air ejection opening formed in a nozzle. The air ejection opening is usually formed around a weft introduction pipe of the nozzle through which the weft yarn is introduced into the nozzle. During picking operation, the weft yarn is dragged or pulled by the dragging force of the air jet from the nozzle, overcoming the resistances of a detaining device for detaining a certain length of the weft yarn required for each pick, of weft yarn guide members and of a grasping device for the weft yarn. In the conventional air jet type weaving looms of this nature, dragging of the weft yarn within and out the nozzle and subsequent carrying of the weft yarn are both achieved by the action of only an air jet of high pressure air. However, this causes drawbacks in which a considerably large amount of high pressure air is consumed and therefore electric power consumption for operation of the loom is increased.

Now, studying the mechanism of the picking of the weft yarn, the dragging force due to air jet is effective only at a high speed range lying within a distance of about 200 mm from the tip of the nozzle. Therefore, at a range remote from the high speed range, the dragging force is declined and accordingly only carrying of the weft yarn is mainly accomplished along the picking course of the weft yarn.

In view of the above, the inventor's attention has been paid to the fact that air jet of high pressure air is not always necessary throughout whole the picking operation of the weft yarn.

SUMMARY OF THE INVENTION

In order to eliminate the drawbacks encountered in the conventional fluid jet looms, according to the present invention, high pressure air is ejected only in an amount sufficient for dragging the weft yarn, and the low pressure air is ejected to accomplish carrying operation of the weft yarn along the picking course of the weft yarn.

It is a main object of the present invention to provide an improved weft picking device for an air jet type weaving loom, which can eliminate the drawbacks encountered in conventional weft picking devices in which weft picking is carried out only by the action of high pressure air jet.

Another object of the present invention is to provide an improved weft picking device for an air jet type weaving loom, which saves energy required for operating the loom and accordingly cost of operation of the loom can be lowered, without causing degradation of the performance of the loom.

A further object of the present invention is to provide an improved weft picking device for an air jet type weaving loom, in which a weft yarn is dragged or pulled by the action of high pressure air jet ejected through a weft inserting nozzle, and thereafter carried through the shed of warp yarns under cooperation of the high pressure air jet and low pressure air jet ejected through the nozzle.

A still further object of the present invention is to provide an improved weft picking device of an air jet type weaving loom, which has a weft inserting nozzle which is provided with a first air passage through which high pressure air is ejected and a second air passage through which low pressure air is ejected, the ejected amount of the high pressure air being much smaller than that of the low pressure air.

These objects, features and advantages of the improved weft picking device according to the present invention will become more apparent from the following description taken in conjunction with the accompanying drawings.

DESCRIPTION OF THE PREFERRED EMBODIMENT

Figure 1:
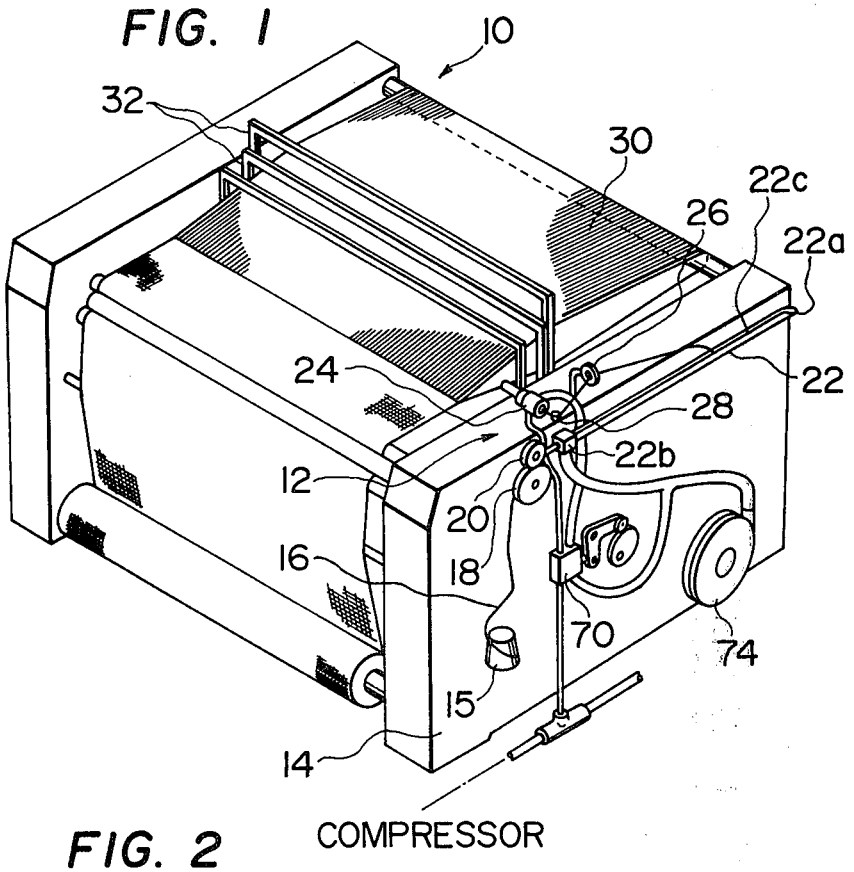
FIG. 1 is a perspective view of an air jet type weaving loom provided with a preferred embodiment of a weft picking device in accordance with the present invention.

Referring now to FIG. 1 of the drawings, there is shown an air jet type weaving loom 10 provided with a preferred embodiment of a weft yarn picking device 12 in accordance with the present invention. The weaving loom 10 is composed of a frame 14 or body. A bobbin 15 for supplying a weft yarn 16 is rotatably attached on a side of the frame 14. The weft yarn 16 is drawn out from the bobbin 15 at a certain speed by the cooperation of a measuring roller 18 and a pressing roller 20. The weft yarn drawn out from the bobbin 15 is introduced into a detaining pipe 22 in which the weft yarn 16 is blown off toward a free end **22*a* of the detaining pipe 22 by the action of an air stream generated from a base portion 22*b* of the detaining pipe 22. Accordingly, the detaining pipe 22 detains therein the weft yarn of a predetermined length required for one pick of the weft yarn. The detained weft yarn 16 is drawn out through an elongate slit 22*c* and then introduced into a weft inserting nozzle 24 through a guide 26 and a grasping device 28. The nozzle 24 formes part of the picking device 12 and is constructed and arranged to project the weft yarn from the tip thereof by the action of pressurized air ejected from the nozzle 12. The projected weft yarn 16 is picked or inserted into the shed of warp yarns 30 which shed is formed by the action of movable healds 32**.

Figure 2:
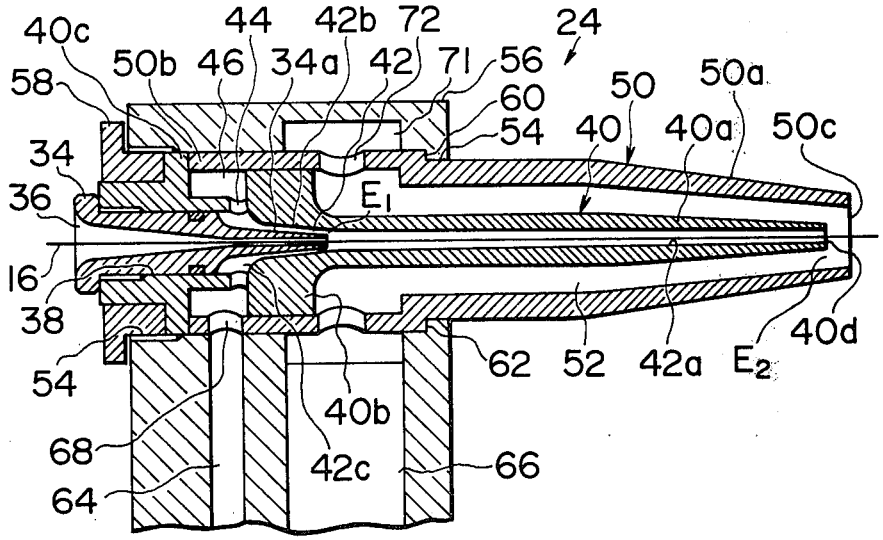
FIG. 2 is a cross-sectional view of an example of a weft inserting nozzle forming part of the weft picking device in FIG. 1.

FIG. 2 illustrates in detail a preferred example of the nozzle 24 which comprises a weft yarn introduction pipe 34 through which the weft yarn 16 is introduced into the nozzle 24. The pipe 34 is formed therethrough with an opening 36, and its one end **34*a* is formed into the frustoconical shape. The pipe 34 is screwed into an cylindrical bore 38 of a first or inner body 40 which bore 38 is formed coaxially with the nozzle 24. The inner body 40 is formed with a generally straight elongate pipe portion 40*a* in which an elongate opening 42 or high pressure air passage is formed. The opening 42** is composed of a straight cylindrical portion or opening 42*a* and a tapered portion or opening 42*b* in which the frustoconical end portion 34*a* of the pipe 34 lies maintaining a space around the outer surface of the end portion 34*a*. A high pressure air ejection opening $E_1$ is formed between the tip of the frustoconical end portion 34*a* of the pipe 34 and the inner surface of the inner body 40.

As shown, the opening 42 extends to the cylindrical bore 38 to form a high pressure air introducing portion or space 42*c*. The introducing portion 42*c* communicates through a plurality of through holes 44 with an annular high pressure air distribution passage 46 which is defined between the outer surface of the inner body 40 and the inner surface of a second or outer body 50. The outer body 50 is generally formed into the shape of pipe whose one end portion 50*a* is generally formed into the frustoconical shape. The outer body 50 is installed to surround the pipe portion 40*a* of the inner body 40 in a manner that the inner surface of the outer body 50 contacts the peripheral surface of a radial annular portion 40*b* of the inner body 40. Additionally, the cylindrical end portion 50*b* of the outer body 50 contacts the radial annular flange portion 40*c* of the inner body 40. The inner surface of the outer body 50 is spaced apart from the outer surface of the pipe portion 40*a* of the inner body 40 so as to define therebetween a low pressure air passage 52. The reference character $E_2$ indicates an annular low pressure air ejection opening defined between the inner surface of the outer body 50 and the outer peripheral surface of the tip of the pipe portion 40*a* of the inner body 40, so that the low pressure air within the passage 52 is ejected through the opening $E_2$.

As viewed, the outer body 50 is securely disposed in a cylindrical bore 54 in a manner that the cylindrical end portion 50*b* is forced through the flange portion 40*c* by the action of a screwed check or rock nut 58 so that the step portion 60 of the outer body 50 sealingly contacts the step portion 62 of a support block 56. The rock nut 58 is, as shown, screwed into the cylindrical bore 54 of the support block 56. The support block 56 is formed with a high pressure air induction passage 64 and a low pressure air induction passage 66. The high pressure air induction passage 64 communicates through a through hole 68 with the annular high pressure air distribution passage 46. The high pressure air induction passage 64 is communicable with a high pressure air source such as a compressor through a valve 70 (shown in FIG. 1) which is arranged to open or close in accordance with the operation of the loom 10. The low pressure air induction passage 66 directly communicates with an annular low pressure air distribution passage 71. The passage 71 communicates through a plurality of through holes 72 with the low pressure air passage 52 formed between the inner surface of the outer body 50 and the outer surface of the pipe portion 40*a* of the inner body 40. The holes 72 are formed through the cylindrical wall of the outer body 50. The low pressure air induction passage 66 communicates through the valve 70 with a low pressure air source such as a blower 74 through the outlet of the blower as shown in FIG. 1. The blower 74 is constructed and arranged to supply air into the detaining pipe 22. It is to be noted that the pressurized air from the high pressure air source is, for example, at 4 kg/cm$^2$, and that from the low pressure air source is at 1.6 kg/cm$^2$. Therefore, the pressure of air from the high pressure air source is much higher than that from the low pressure air source.

The operation of the thus arranged weft yarn picking device 12 will be illustrated hereinafter with reference to FIGS. 1 and 2.

When shedding is carried out to form the shed of the warp yarns 30, the valve 70 is opened to supply high pressure air into the high pressure air induction passage 64 and low pressure air into the low pressure air induction passage 66. The high pressure air is admitted through the through holes 68 into the annular air distribution passage 46 and then supplied through the through hole 44 into the space 42*c*. The high pressure air is thereafter ejected through the air ejection opening $E_1$ into the straight cylindrical portion 42*a* of the high pressure air passage 42. At this moment, the weft yarn inserted through the introduction pipe 34 in the state of FIG. 2 is dragged or pulled rightward in FIG. 2 by the action of the high pressure air to be picked through an opening 40*d* into the shed of the warp yarns 30. Simultaneously, low pressure air introduced into the passage 52 through the holes 72 from the induction passage 66 is ejected from an opening 50*c* so as to enclose the air jet stream from the air passage 42*a* of the inner body 40, thereby assisting the carrying operation of the weft yarn to complete the picking of the same. It is to be noted that even after dragging force of the high pressure air is weakened or lost, the weft yarn can be carried through the shed of the warp yarns under cooperation of the high and low pressure air.

Figure 3:
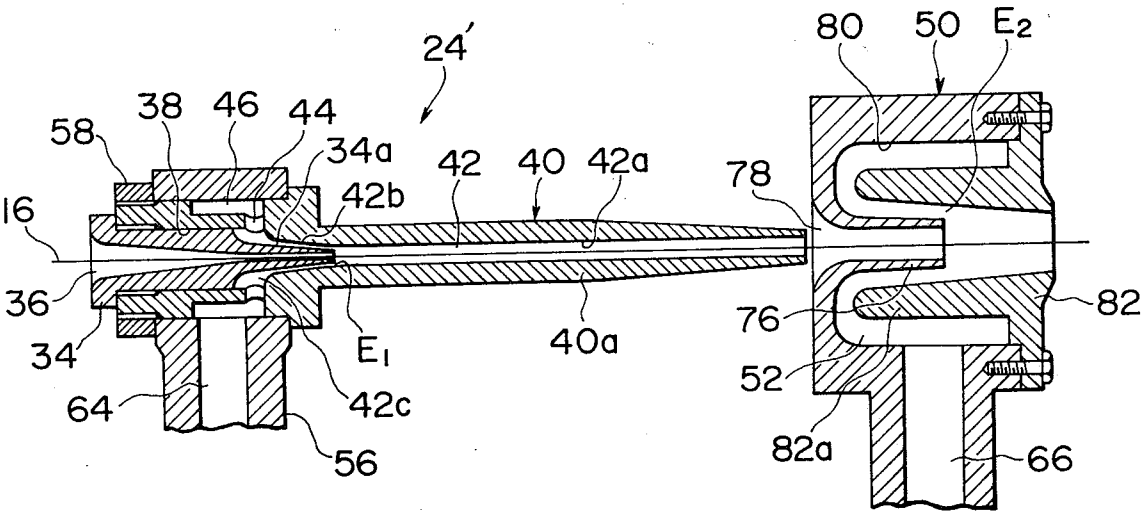
FIG. 3 is a cross-sectional view of another example of a weft inserting nozzle of the weft picking device in accordance with the present invention.

FIG. 3 illustrates another preferred example of the nozzle 24' which is similar to the example of FIG. 2 with the exception that the first and second bodies 40 and 50 are formed and located separately from each other. Accordingly, like reference numerals are assigned to like parts and elements.

As viewed, the second body 50 or a cup-shaped member is formed with a pipe portion 76 defining therethrough a straight opening 78 through which the weft yarn 16 from the straight opening 42*a* of the first body 40 passes. In this regard, the axis of the pipe portion 76 is aligned with that of the first body 40. The second body 50 is formed with a generally annular recess 80 around the pipe portion 76. The reference numeral 82 indicates a rid member secured to the second body 50. The rid member 82 has a generally cylindrical projection or portion 82*a* which is located within the annular recess 80 so as to be spaced apart from the wall surface of the second body 50 in order to form the low pressure air passage 52 which is generally in M-shape in cross-section as shown in FIG. 3. The low pressure air passage 52 communicates through the low pressure air induction passage 66 with the low pressure air source. As seen, in this case, the tip of the pipe portion 40*a* of the first body 40 is in close proximity to the opening 78 formed in the second body 50, but is not inserted into the same opening 78.

It will be understood that the operation of the weft yarn picking device 12 equipped with the thus arranged nozzle 24' is substantially the same as that of the device 12 equipped with the nozzle 24 of FIG. 2.

The mechanism of dragging or pulling the weft yarn will be explained in detail hereinafter.

The dragging or pulling force applied to the weft yarn 16 is generated by the friction between the weft yarn 16 and the air stream passing through the straight opening 42*a* of the first body 40. Therefore, the dragging force is a function of three elements, i.e., the flow speed of the air stream, the density of air, and the length of the straight opening 42*a*. According to the present invention, the ejecting amount of the high pressure air is decreased by decreasing the area of the annular ejection opening $E_1$, and additionally the diameter of the straight opening 42*a* is decreased in accordance with the decreased area of the ejection opening $E_1$. Therefore, the air density within the straight opening 42*a* and the air flow speed particularly at the meddle portion of the opening 42*a* are maintained approximately the same as in a conventional weft yarn projecting nozzle which is constructed to eject only high pressure air to carry the weft yarn. Under such a condition of the nozzle according to the present invention, the dragging force becomes the same as in the conventional nozzle if the length of the straight opening 42*a* is the same as in the conventional nozzle. It will be understood that the values of above-mentioned three elements may be varied and selected in accordance with the relationship thereamong.

In this regard, in design of the conventional nozzle, the length of the straight opening (42*a*) of the nozzle is usually selected within a range from 10 to 20 cm. Because, if the length of the straight opening of the nozzle is less than 10 cm, sufficient dragging force cannot be obtained; if the length exceeds 20 cm, the flow resistance of air flowing through the straight opening (42*a*) becomes too high and accordingly air ejected from an annular air ejection opening ($E_1$) is liable to flow backward into the opening (36) of the weft yarn introduction pipe (34).

According to the present, it seems to be necessary to select the length of the straight opening 42*a* in consideration of the fact that the diameter of the straight opening 42*a* is less and accordingly the flow resistance within the straight opening 42*a* increases. However, the length of the straight opening 42*a* of the nozzle 24 according to the present invention could be determined to a value same as in the conventional nozzle, since the amount of the high pressure air has been limited approximately to $\frac{1}{4}$ of that in the conventional nozzle as will be discussed hereinafter.

An example of specifications of the nozzle (according to the present invention) exhibiting the same picking performance as in the conventional nozzle was determined by experiments discussed hereinafter.

The experiments were made using a testing device which was provided with a generally cylindrical air guiding comb (not shown) in which an air guide channel for air stream is formed along the axis of the guiding comb. The guiding comb consists of a plurality of known annular guide members which are such arranged that the axes of the guide members are aligned with the axis of the nozzle 24. The air guiding comb is located spaced apart from the tip of the nozzle 24 by 15 cm. Each guide member is 2.9 cm in thickness, and the guide member are located at intervals of 0.8 mm. Each guide members forms at its inner periphery with a tapered opening constituting the air guide channel.

Furthermore, a Pitot tube (not shown) was inserted to the air guide channel of the air guiding comb to measure the flow speed of air at a location spaced apart by about 50 cm from the tip of the nozzle 24. It is to be noted that identifying the carrying performances of the weft yarns between the conventional nozzle and the nozzle according to the present invention can be achieved by measuring the air flow speed at this location in the air guide channel of the air guiding comb. Because, at this location, the carrying operation of the weft yarn is accomplished by the high and low pressure air which are joined together. Additionally, this testing device was provided with a valve substantially same as that indicated by the reference numeral 70.

A weft inserting nozzle prepared as a conventional one was substantially the same in construction as the arrangement which was made by omitting the parts relating to the low pressure air ejection such as the second body 50 and the low pressure air induction passage 66 etc, from the arrangement shown in FIG. 2. The dimentions of the nozzle were as follows: the outer diameter of the annular air ejection opening ($E_1$) and the diameter of the straight opening (42*a*) are 6 mm, respectively; the outer diameter of the weft introduction pipe 34 in close proximity to the air ejecting opening ($E_1$) was 3.6 mm; the length of the straight opening (42*a*) is 150 mm. A nozzle having such dimentions has been conventionally used. As a weft inserting nozzle in accordance with the present invention, one having the same construction as in FIG. 2 and the following dimentions was prepared: the outer diameter of the annular air ejection opening and the diameter of the straight opening 42*a* were 3 mm, respectively; the outer diameter of the weft introduction pipe 34 in close proximity to the air ejection opening $E_1$ was 1.8 mm; the length of the straight opening 42*a* was 150 mm which is the same as the above-mentioned conventional nozzle. It will be understood that the cross-sectional area of the annular high pressure air ejection opening $E_1$ of the nozzle according to the present invention was $\frac{1}{4}$ of that of the nozzle prepared as the conventional one.

Experiments were made as follows: the weft inserting nozzle prepared as the conventional one was installed or set on the above-mentioned testing device and then the nozzle was supplied with a high pressure air having pressure of 4 kg/cm$^2$ in order to eject the high pressure air through the air ejection opening ($E_1$). In this experiment, the opening and closing timings of the valve (70) was set to control the consumed amount of air to 160 l/min (being converted into the volume at atmospheric pressure). It is to be noted that the opening and closing timings of the valve (70) corresponds to the weft yarn picking frequency per minute. Under this condition, the tension of the picked weft yarn was measured to know the dragging force of the air stream ejected from the nozzle, and the flow speed of the air stream in the weft guide channel of the weft guiding comb was measured by the Pitot tube. It is to be noted that the above-mentioned air pressure of 4 kg/cm$^2$ and the air consumed amount of 160 l/min were determined by the fact that such values had been usually used in the operations of conventional air jet type looms.

Thereafter, only the high pressure air nozzle prepared for the nozzle according to the present invention was installed or set on the testing device in place of the above-mentioned conventional nozzle, maintaining the same opening and closing timings of the valve (70) as in the experiment of the conventional nozzle. Under this condition, high pressure air of 4 kg/cm$^2$ was supplied to the first body 40 or high pressure air nozzle to know the dragging force of the air stream by measuring the tension of the picked weft yarn. As a result, it was observed that even only the high pressure air nozzle 40 could exhibit the same dragging force as in the conventional nozzle.

Furthermore, a weft inserting nozzle as shown in FIG. 2 was constructed using the above-mentioned high pressure air nozzle 40. In this experiment, the low pressure air was supplied from the same blower as indicated by the reference numeral 74 in FIG. 1, and the high pressure air of 4 kg/cm$^2$ was supplied from the compressor. Under such a condition, in order to render the air flow speed the same as in the conventional nozzle, the pressure within the low pressure air induction passage 66 was controlled and the cross-sectional area of the low pressure air ejection opening $E_2$ was varied. As a result, the air flow speed by the nozzle according to the present invention became the same as in the conventional nozzle when the pressure within the low pressure air induction passage 66 was 0.16 kg/cm$^2$ and the air flow amount was 160 l/min (at atmospheric pressure). Additionally, the outer diameter of the tip of the pipe portion 40*a* of the first body 40 was 4 mm, and the inner diameter of the second body 50 adjacent the tip of the pipe portion 40*a* was 11.5 mm. It is to be noted that the air flow speed measured by the Pitot tube was 160 m/sec.

Now, in order to compare electric powers consumed for the operations of the air jet looms equipped with the conventional nozzle and the nozzle according to the present invention, the consumed electric powers were estimated on the ground that the flow amount of the high pressure air of the nozzle according to the present invention was $\frac{1}{4}$ of that of the conventional nozzle, because the cross-sectional area of the high pressure air ejection opening $E_1$ was $\frac{1}{4}$ of that of the conventional nozzle as discussed above, and the flow speed of air adjacent the ejection opening $E_1$ became approximately a constant level which was in the vicinity of the velocity of sound. The result of estimation is shown in the following table.

| | | |
|---|---|---|
| Conventional nozzle | | Consumed electric power was 0.56 kw under the conditions where pressure: 4 kg/cm$^2$, consumed amount: 160 l/min |
| Nozzle according to the present invention | (1) | Consumed electric power was 0.14 kw under the conditions where pressure: 4 kg/cm$^2$ and consumed amount: 40 l/min (160 l/min × $\frac{1}{4}$). |
| | (2) | Consumed electric power was 0.05 kw under the conditions where pressure: 0.16 kg/cm$^2$ and consumed amount: 160 l/min. Total consumed electric power was 0.19 kw |

It will be appreciated from the above table, that about $\frac{1}{3}$ of the electric power consumed for weft picking operation in the conventional nozzle is sufficient for the weft picking operation in the nozzle according to the present invention. Even if the specifications of the nozzle according to the present invention will be varied in accordance with the requirements for various manners of weft pickings, it will be understood that the consumed electric power can be lowered to a considerable extent by employing the present invention as compared with conventional techniques.

Recently, the number of looms in a factory tends to increase so that each factory is usually provided with several tens of looms. Under such a situation, since it costs much when each loom is equipped with a compressor for supplying high pressure air, a considerable number of looms are connected through piping to a high pressure air compressor in order to distribute high pressure air from the compressor to the looms. In this regard, the discharge pressure of the compressor must be kept at about 7 kg/cm$^2$ in order to supply high pressure air of 4 kg/cm$^2$ to the looms, in consideration, for example, of air flow resistance in piping connecting between the compressor and each loom. In this situation, the difference in consumed electric power becomes larger between the cases of the conventional nozzle and the nozzle according to the present invention. Because, the consumed electric power progressively increases as the increase of pressure of air supplied to the weft inserting nozzle. In other words, in case of each loom equipped with the conventional nozzle, air of 160 l/min must be compressed to increase the pressure to a level of 7 kg/cm$^2$ and accordingly the consumed electric power is 0.72 kw. On the contrary, in case of each loom equipped with the nozzle according to the present invention, it is sufficient that air of only 40 l/min is compressed to a level of 7 kg/cm$^2$ and accordingly the consumed electric power is 0.18 kw which is $\frac{1}{4}$ of electric power consumed in the case of the loom equipped with the conventional nozzle. Additionally, further consumed electric power of 0.05 kw is necessary in case of the loom equipped with the nozzle according to the present invention, for the low pressure air ejected from the nozzle. Therefore, consumed electric power becomes 0.23 kw in total per each loom equipped with the nozzle according to the present invention.

It is to be noted that the improvement in consumed electric power is estimated to be 0.37 kw (0.56 kw−0.19 kw) in this situation, although the improvement has been estimated to be 0.49 kw (0.72 kw−0.23 kw) in the situation discussed in the above-mentioned table. This demonstrates the fact that the consumed electric power can be decreased to a considerable extent particularly in this situation wherein a plurality of looms are supplied with compressed air from only a compressor.

Moreover, in case of the loom equipped with the nozzle according to the present invention, since a relatively small amount of high pressure air is used, a high pressure pump having a small capacity is sufficient and therefore the cost of equippments can be decreased. Additionally, it is possible to install a small size high pressure pump on each loom. In such a case, it is sufficient to pressurize air to 4 kg/cm$^2$ by the high pressure pump. Consequently, air of 40 l/min can be sufficiently compressed to 4 kg/cm$^2$ by the consumed electric power of 0.14 kw and therefore energy consumed for the loom equipped with the nozzle according to the present invention can be further decreased by installing the small size air pump on each loom.

As is appreciated from the foregoing, according to the present invention, a large amount of low pressure air which is relatively low in preparing cost can be effectively used, considerably decreasing the consumed amount of high pressure air which is relatively high in preparing cost. By this fact, energy saving can be improved and cost for operation of the loom can be lowered without degradation of performance of the loom.

What is claimed is:

1. A weft picking device for an air jet type weaving loom, comprising a weft inserting nozzle for inserting a weft yarn through the shed of warp yarns, said weft inserting nozzle including, a weft introduction pipe member disposed in said nozzle and having an opening through which the weft yarn is introduced into said nozzle, the opening of said pipe member being coaxial with said nozzle;

means defining a first air passage through which high pressure air is ejected along the axis of said nozzle to pull the weft yarn toward the shed of the warp yarns, the first air passage defining means including a first pipe member whose axis is aligned with the axis of said weft introduction pipe member, said first pipe member having an elongate opening which communicates with a high pressure air source to eject the high pressure air therethrough, the tip portion of said introduction pipe member being located in the elongate opening of said first pipe member;

means defining a second air passage through which low pressure air is ejected along the axis of said nozzle to carry the weft yarn through the shed of the warp yarns in cooperation with the high pressure air, the low pressure air being lower in pressure than the high pressure air, at least a part of said second air passage being disposed circumferentially around a length of said first air passage; and means for setting the low pressure air ejected through said second air passage larger in amount than the high pressure air ejected through said first air passage.

2. A weft picking device as claimed in claim 1, in which said weft introduction pipe member having a tip portion having a frustoconical shape, and the frustoconical tip portion being located in the elongate opening of said pipe member.

3. A weft picking device as claimed in claim 2, in which said weft introduction pipe member is securely disposed in a bore formed in said first pipe member.

4. A weft picking device as claimed in claim 3, in which said first pipe member is formed with an elongate pipe portion through which said elongate opening is formed.

5. A weft picking device as claimed in claim 4, in which the second air passage defining means includes a second pipe member which is disposed coaxially with said first pipe member to enclose said first pipe member said second pipe member being located spaced apart from the outer surface of the pipe portion of said first pipe member to define a generally cylindrical opening between the outer surface of the pipe portion of said first pipe member and the inner surface of said second pipe member, said generally cylindrical opening communicating with a low pressure air source to eject the low pressure air therethrough.

6. A weft picking device as claim in claim 5, in which said low pressure air source is a blower for generating an air stream.

7. A weft picking device as claimed in claim 2, in which said high pressure air source is an air compressor for pressurizing air.

8. A weft picking device for an air jet type weaving loom, having a weft inserting nozzle for inserting weft yarn through the shed of warp yarns, said weft picking device comprising:

a high pressure air source;

a low pressure air source whose air pressure is lower than that of said high pressure air source;

a weft introduction pipe member disposed in said nozzle and having an opening through which the weft yarn is introduced into said nozzle, the opening of said pipe member being coaxial with said nozzle;

means defining a first air passage forming part of said nozzle and communicable with said high pressure air source to eject high pressure air along the axis of said nozzle effective to pull the weft yarn toward the shed of the warp yarns, the first air passage defining means including a first pipe member having an elongate opening which is communicable with said high pressure air source to eject the high pressure air therethrough, the tip portion of said weft introduction pipe member being located in the elongate opening of said first pipe member;

means defining a second air passage forming part of said nozzle and communicable with said low pressure air source to eject low pressure air along the axis of said nozzle effective to carry the weft yarn through the shed of the warp yarns in cooperation with the high pressure air, at least a part of said second air passage being disposed circumferentially around a length of said first air passage, a major part of said second air passage being formed around said first pipe member of said first air passage defining means; and means for setting the low pressure air ejected through said second air passage larger in amount than the high pressure air ejected through said first air passage.

9. A weft picking device for an air jet type weaving loom, having a weft inserting nozzle for inserting a weft yarn through the shed of warp yarns, said weft picking device comprising:

a compressor for producing high pressure air by pressurizing air;

a blower for producing a stream of low pressure air which is lower in pressure than the high pressure air;

a weft introduction pipe member disposed in said nozzle and having an opening through which the weft yarn is introduced into said nozzle, the opening of said pipe member being coaxial with said nozzle;

means defining a first air passage forming part of said nozzle and communicable with said compressor to eject high pressure air along the axis of said nozzle so as to pull the weft yarn toward the shed of the warp yarns, the first air passage defining means including a first pipe member which has an elongate opening which is communicable with said compressor to eject the high pressure air therethrough, the tip portion of said weft introduction pipe member being located in the elongate opening of said first pipe member;

means defining a second air passage forming part of said nozzle and communicable with said blower to eject the low pressure air along the axis of said nozzle so as to carry the weft yarn through the shed of the warp yarns in cooperation with the high pressure air, at least a part of said second air passage being disposed circumferentially around a length of said first air passage, a major part of said second air passage being formed around said first pipe member of said first air passage defining means; and means for setting the low pressure air ejected through said second air passage larger in amount than the high pressure air ejected through said first air passage.

* * * * *